United States Patent [19]

Hornstein

[11] Patent Number: 5,056,399

[45] Date of Patent: Oct. 15, 1991

[54] AUDIO REACTIVE LIGHT DISPLAY

[75] Inventor: Richard Hornstein, Mill Valley, Calif.

[73] Assignee: Mark Watts, Mill Valley, Calif.

[21] Appl. No.: 617,022

[22] Filed: Nov. 21, 1990

[51] Int. Cl.[5] ..... A63J 17/00

[52] U.S. Cl. ..... 84/464 R; 340/815.11

[58] Field of Search ..... 84/464 R; 340/815.11, 340/148

[56] References Cited

U.S. PATENT DOCUMENTS 3,845,468 10/1974 Smith ..... 84/148

4,440,059 4/1984 Hunter ..... 84/464 R

*Primary Examiner*—L. T. Hix

*Assistant Examiner*—Jae N. Noh

*Attorney, Agent, or Firm*—Heller, Ehrman, White & McAuliffe

[57] ABSTRACT

An audio reactive display for generating a random light pattern.

12 Claims, 2 Drawing Sheets

AUDIO REACTIVE LIGHT DISPLAY

BACKGROUND OF THE INVENTION

1. Field of the Invention

The present invention relates generally to audio responsive devices, and more particularly to audio reactive light displays.

2. Description of the Prior Art

Color generators or color organs have been frequently used in the past either to provide entertainment or to serve as an advertising medium. An audio transducer may be used to couple a color organ or generator to a sound source. The color organ includes amplitude and frequency selection features that can be adjusted to respond to the audio signal and to turn on lights. Such devices may operate on a threshold principle; i.e., the loudness of the received audio signal determines the light setting. Alternatively, variable gain controls may be used to vary the threshold according to the average audio signal received.

These audio-responsive light devices or color organs may also employ an analog filter to differentiate low, middle, and high frequencies to illuminate specific incandescent light sources or to vary the frequency of the current applied. These devices produce somewhat predictable display patterns.

Accordingly, an object of the present invention is to provide an audio-responsive circuit for producing randomized display patterns.

A more specific object of the present invention is to provide an audio reactive light display that produces random and unpredictable movement of light sources within a light source array.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

SUMMARY OF THE INVENTION

The present invention is directed to an audio display module and audio responsive circuit. The display module includes a plurality of light sources mounted in an enclosure. The audio responsive circuit is connected in circuit with the light sources. The circuit includes means for providing an electrical signal representative of an audio signal. Additionally, the circuit includes at least first and second counter means for driving the light sources in response to the electrical signal. Each of the counter means has first and second inputs responsive to a positive and a negative edge, respectively, of the electrical signal to initiate the operation of the counter means. The circuit also includes means for altering which of the first and second counter means responds to the positive or negative edges of the electrical signal.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

DESCRIPTION OF THE PREFERRED EMBODIMENT

Figure 1:
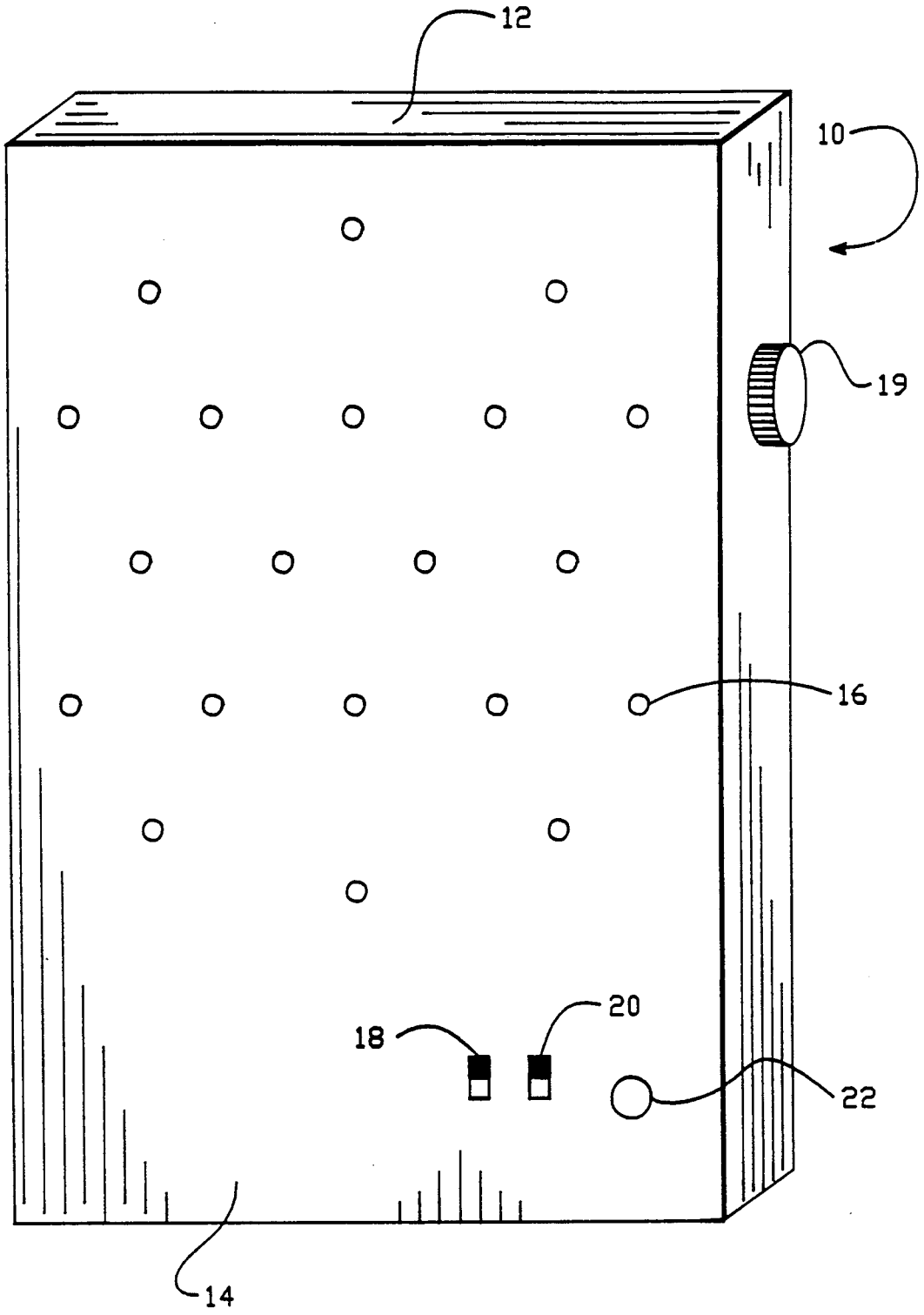
FIG. 1 is a perspective, schematic view of an audio reactive light display according to the present invention.

Referring now in detail to the drawings, and initially to FIG. 1, an audio display module or audio reactive light display 10 is shown. As shown, the device 10 comprises a rectangular housing 12 having a front surface or face 14. The housing 12 and front face 14 may be made of any suitable material, such as plastic or wood. An array or a series of light sources 16 are mounted in front face 14 of device 10 to be visible to an observer. The light sources 16 may comprise a series of sixteen to twenty, for example, light emitting diodes (LEDs). The LEDs may be mounted on a circuit board with the other components of the circuit discussed below. The LEDs would be visible through front face 14, which may be in the form of a plastic mask having suitable openings for each LED. Solid-state LEDs are preferred as they provide a brilliant light source and are longlasting. However, if desired, other light sources may be used.

Additionally, front face 14 includes an on-off switch 18, a sensitivity control 19, a mode switch 20, and a microphone 22. The on-off switch 18 will turn the audio-responsive device 10 on and off. The control 19 varies the sensitivity of device 10 to an input audio signal. The mode switch 20 is used to select between two different modes of response depending upon the music. One mode is most appropriate for music that is beat dependent, such as rap, reggae, or rock and roll. The other mode is for light music such as pop, jazz, and classical music. The microphone 22 is provided to couple the audio-responsive circuit to any audio source, such as a radio or stereo system.

Other suitable transducers may be used in place of the microphone. Also, the coupling device may be eliminated, and the electrical signal which is representative of the audio signal and which would be applied to an audio speaker, for example, may be fed directly to the audio-responsive circuit of the present invention. This signal may be picked up at a preamplifier, for example, of radio, tape recorder, etc.

Figure 2:
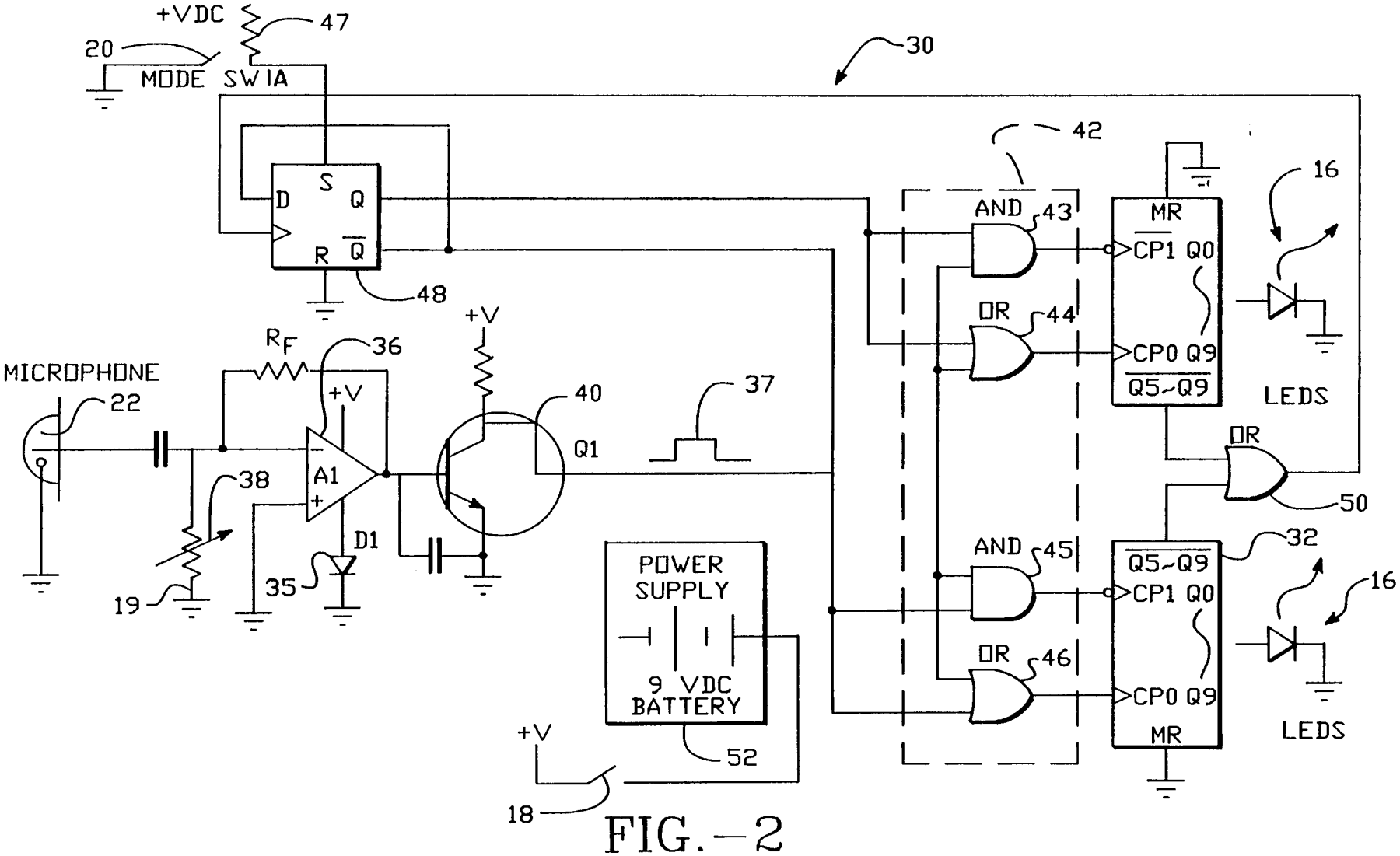
FIG. 2 is a circuit diagram illustrating an audio coupling or responsive circuit according to the present invention.

As shown in FIG. 2, the audio-responsive circuit, represented generally by reference numeral 30, is built around a pair of sequential counters 32 and 34. The counters may be Johnson decade counters. As noted, an audio input from an audio source can be converted to an electrical signal or waves by condenser microphone 22. The signal from the microphone is applied to the inverting input of amplifier 36. The amplifier is a low power, single positive supply amplifier. It is biased to hit the positive rail, which is approximately the voltage of the power supply, with almost any input audio signal. The amplifier is operated as an edge detector. As such, when it sees an input audio signal, it produces a direct current (DC) pulse at the power supply voltage. This ensues that there are appropriate voltage thresholds for the clock inputs of counters 32 and 34. A resistor $R_F$ represents the feedback resistance of the amplifier. A diode 35 is provided for reverse polarity safety.

Additionally, a variable resistor 38 is connected to the inverting input of amplifier 36. The resistance of resistor 38 is varied by tuning knob 19 on housing 12. As noted, the tuning knob adjusts the circuit's sensitivity to an input audio signal. As discussed further below, mode switch 20 in circuit 30 includes switch SWIA. The mode switch SWIA is connected between ground and a D flip-flop circuit 48.

The base of an NPN, small signal transistor 40 may be connected at the output of amplifier 36. The transistor's emitter is connected to ground, and its collector is connected to a voltage source +V through resistor 39. The transistor conditions the current for the input clocks of counters 32 and 34. As shown, bandpass capacitors 31 and 41 are used around amplifier 36 and transistor 40 as appropriate for the input audio frequencies.

The audio signal from transistor 40 is in the form of a square-wave pulse 37. This signal is applied to a data selection logic network 42 via the collector of transistor 40. The logic network 42 comprises a pair of AND gates 43 and 45, and a pair of OR gates 44 and 46. As illustrated, one input to gates 43–46 is the signal from transistor 40. The other input to these gates is an output signal from D flip-flop circuit 48. Specifically, the Q output signal of flip-flop 48 is applied to gates 43 and 44. The other output signal ($\overline{Q}$=Q not) from flip-flop 48 is applied to gates 45 and 46.

The output of gates 43 and 44 are connected to clock inputs $\overline{CP1}$ and CP0, respectively, of counter 34. The output of gates 45 and 46, in turn, are connected to clock input $\overline{CP1}$ and CP0 of counter 32. Clock inputs CP0 respond to the positive edge of the audio signal, while clock inputs $\overline{CP1}$ respond to the negative edge of the signal. If the signal is applied to the CP0 input, then the $\overline{CP1}$ input must be held at a low (ground) level. On the other hand, if the signal is applied to the $\overline{CP1}$ input, the CP0 input must be held high, i.e., at the battery voltage level.

The decade counters produce ten output drive pulses or signals (Q0–Q9) which are applied to the light sources. Preferably, each counter drives one-half of the light sources in a display array. For example, if the array includes twenty LEDs, counters 32 and 34 each drive ten LEDs. Of course, the counters may be connected in circuit with the LEDs so one drives more light sources than another.

In operation, only two light sources are on at any given time, as the counter sequentially produces an output pulse to the display portion it operates. Each counter will apply an output signal to a light source at the reception of a positive or negative edge of an input audio signal. The time between illumination of specific light sources depends upon the frequency of the audio input and/or the input's polarity.

The output signals ($\overline{Q5–Q9}$) from each counter 32 and 34 are also applied as inputs or OR gate 50. The output of gate 50 is applied to clock input CLK of flip-flop 48. The other input D of flip-flop 48 is connected to the flip-flop's $\overline{Q}$ output.

The circuit includes a power supply 52, which may be in the form of a nine volt direct current (DC) battery rated at 650 milliamps. Power to circuit 30 is controlled by on/off switch 18. Although at particular frequencies or amplitudes, it appears as if all or a majority of the LEDs are illuminated, as discussed, only two are on. This offers the advantage of a longer battery life.

The operation of circuit 30 will now be described. As noted, the incoming audio signal from microphone 22 has a positive and negative edge. The signal is amplified by amplifier 30, and conditioned and converted to a square-wave pulse 37 by transistor 40. The logic network 42 receives the output signals from the transistor as well as the outputs Q and $\overline{Q}$ of flip-flop 48.

The flip-flop 48 "toggles" or reverses the level of the Q and $\overline{Q}$ outputs when a low to high transition is sensed at either or both inputs of OR gate 50. The input signals to gate 50 transition high at the end of the ten stage cycle of each counter 32 and 34.

Since the counters are not synchronized to each other, the time at which one or both of the signals goes high is random, dependent upon the pattern of the audio input signal. Practically, flip-flop 48 will toggle every few cycles (0–9) of the respective counters. When flip-flop 48 i set ($Q=1,\overline{Q}=0$), a logic signal 1 is applied to AND gate 43 and OR gate 44. The logic signal 1 at gate 43 allows the output of the transistor, the audio signal, to be applied to clock input $\overline{CP1}$ of counter 34. The same logic signal 1 is applied to OR gate 44 forcing its output to go high, correctly biasing the CPO clock input and blocking that input. Counter 34 is now advancing its output and sequencing the LEDs to the negative edge of the audio input signal. At the same time, output $\overline{Q}$ of flip-flop 48 is a low level logic signal. This signal at AND gate 45 forces the output of the gate low, correctly biasing the $\overline{CP1}$ clock input of counter 32, i.e., blocking or disabling the $\overline{CP1}$ input. The same signal applied to OR gate 46 allows the clock to trigger the CP0 clock input of counter 32, which advances the counter at the positive edge of the audio input signal. This logic biasing reversed itself when flip-flop 48 toggles, causing counter 34 to advance at the positive edge (clock input CP0), while counter 32 advances at the negative edge of the audio signal (clock input $\overline{CP1}$).

As can be seen, at irregular intervals, OR gate 50 produces a low to high transition to the clock input of flip-flop 48. This causes the outputs Q and $\overline{Q}$ of the flip-flop to reverse themselves. This, in turn, alters whether counter 32 or 34 is responding to the positive or negative edge of the audio input signal. Both counters are always enabled via the high true master resets (MR) inputs being tied to ground.

Since counters 32 and 34 are not synchronized, they provide unpredictability as to which LED will light. Additionally, there is unpredictability as to when the counters will switch when responding to the "attack" (positive edge) or "decay" (negative edge) of the audio input signal. As discussed, flip-flop 48 only toggles when its input goes from low to high. As such, the two inputs to OR gate 50 must go low, and then one or both must go high to effect the clock polarity switches of the counters. Since the counters are not synchronized, the time of the switching is virtually random. As such, a random light pattern is generated.

When mode switch SWIA is open and switch SWIB closed, flip-flop 48 is held in the set state ($Q=1,\overline{Q}=0$) by applying a +VDC to the set input S of flip-flop 48 via resistor 47. This prevents switching between which counter responds to the attack or decay portion of the audio input signal. More specifically, in this mode, counter 34 always reacts to the decay portion of the pulse, while counter 32 only reacts to the attack portion of the pulse. The disabling of the attack/decay switching causes the LED display to react more abruptly to the audio input without flowing as with the more subtle mid- and high-range portions of the music.

The other position of the mode switch, SWIA closed, disables the set input of flip-flop 48, enabling the attack- /decay switching. This provides for a more sensitive display action. Also, the sensitivity of the display action may be varied by changing the resistance of variable resistor 38.

As can be seen from the above description, the present invention does not rely on specific frequencies which illuminate certain light sources. Rather, the visual effect is created by the random movement of two independent illuminated light sources within a light source array. As discussed, sequencing of the light sources during movement is controlled by the output of amplifier 36, which is applied to the input of counters 32 and 34. These counters sequence to the next output at either the positive or negative slope of the incoming audio signal. More specifically, one of the counters will advance at the positive edge of the music, while the other counter advances at the negative edge of the music. This produces apparent movement throughout the light source array at the time of, and often after, the beat or note. This produces a syncopated movement, embellishing the rhythm of the audio signal.

The present invention can produce the following visual effects. The light sources, for example the LEDs, may move in a dual fashion to the beat and/or after the beat, twirl right and left, and sparkle in areas or throughout the display. The two counters, each, for example, driving different halves of the light sources and not synchronized to each other, respond to either the attack or decay portion of the audio input. This produces unpredictable patterns of illumination in the light source array, such that the odds of the same pattern being produced by the next response to the incoming audio signal is the order of $2^{10}$. This result coupled with the unpredictability of the music creates an ever-changing pattern of dual points of light, swirling designs, geometric forms, and full-display sparkles.

Even though there is no specific filtering of low, middle, and high frequencies, the display appears to respond differently to various musical frequencies. The display is unpredictable as to which one of the sets of LEDs will light at the next audio input. Additionally, it is unpredictable as to which LED will respond to the attack or decay of the audio input.

If the input to a counter is not long enough to allow a counter to settle on a specific output, the spurious current applied to the counter causes it to quickly run through its outputs. This has the effect of allowing most or all of the LEDs to momentarily light.

By selectively lighting the LEDs, as discussed, various geometric forms or constellations are produced on the face of display device 10. Additionally, simulated movement of the light sources is provided.

All the active components of circuit 30 are preferably low power CMOS devices drawing up to a maximum of 50 microamps. For example, the AND gates 43 and 45 may be a 4081 CMOS device, and the OR gates 44 and 46 may be a 4071 CMOS device. The counters 32 and 34 may be 4017 CMOS counters. And the flip-flop 48 may be a 4013 CMOS device.

The present invention has been described in terms of the preferred embodiment. The invention, however, is not limited to the embodiment depicted and described. Rather, the scope of the invention is defined by the appended claims.

What is claimed is

1. An audio responsive circuit, comprising:

(a) means for providing an electrical signal representative of an audio signal;

(b) at least first and second counter means for driving a plurality of light sources in response to said electrical signal, each counter means having first and second inputs responsive to a positive and a negative edge respectively, of said electrical signal to initiate the operation of said counter means; and (c) means for altering which of said first and second counter means responds to said positive and negative edge of said electrical signal.

2. An audio display module, comprising:

a plurality of light sources;

an audio responsive circuit connected in circuit with said light sources, said audio responsive circuit including:

(a) means for providing an electrical signal representative of an audio signal, (b) at least first and second counter means for driving said light sources in response to said electrical signal, each counter means having first and second inputs responsive to a positive and a negative edge, respectively, of said electrical signal to initiate the operation of said counter means; and (c) means for biasing said inputs to vary which of said first and second counter means responds to said positive and negative edge of said electrical signal.

3. The module of claim 2 wherein said biasing means includes a flip-flop circuit means and means for applying different output signals from said flip-flop circuit means to said inputs of first and second counter means in response to changes in the drive signals from said first and second counter means.

4. The module of claim 3 wherein said applying means includes an OR gate to which the drive signals of said first and second counter means are applied, the output of said OR gate connected in circuit with the clock input of said flip-flop circuit means.

5. The module of claim 4 wherein the output signals of said flip-flop circuit means are applied to said first and second inputs of said first and second counter means by a logic network area means including AND and OR gates.

6. The module of claim 5 wherein the OR and AND gates of said logic network area means are connected to the first and second inputs of said first and second counter means.

7. The module of claim 6 further including an amplifier means for amplifying said electrical signal.

8. The module of claim 7 further including a transistor means for converting said electrical signal to a square-wave pulse signal.

9. The module of claim 2 further including mode switching means for operating said biasing means so said first and second counter means respond only to one of the positive or negative edge of said electrical signal applied to said counter means.

10. The module of claim 9 further including a variable resistor means connected between ground an inverting input of an amplifier means for amplifying said electrical signal, said variable resistor means for varying the sensitivity of the module to said electrical signal.

11. The module of claim 2 wherein said light sources are light emitting diodes, and said first and second counter means each drive half of the total of said light emitting diodes.

12. The module of claim 1 or 2 wherein said first and second counter means comprise decade counters.

* * * * *